United States Patent [19]

Frye

[11] Patent Number: 4,920,904

[45] Date of Patent: May 1, 1990

[54] TAPE FEEDING METHOD AND APPARATUS

[76] Inventor: Ricky J. Frye, 1516 Rosina Dr., Miamisburg, Ohio 45342

[21] Appl. No.: 123,966

[22] Filed: Nov. 23, 1987

[51] Int. Cl.[5] ..... D05B 35/06; D05B 37/06

[52] U.S. Cl. ..... 112/262.1; 112/121.27; 112/114; 112/130; 112/152

[58] Field of Search ..... 112/121.27, 130, 152, 112/136, 153, 262.1, 265.1, 262.3, 121.12, 113, 114, 104, 121.15

[56] References Cited

U.S. PATENT DOCUMENTS

| | | | |
|---|---|---|---|
| 3,381,639 | 5/1968 | Miller | 112/130 |
| 3,680,509 | 8/1972 | Miller | 112/152 |
| 4,333,409 | 6/1982 | Rockerath | 112/152 X |
| 4,376,415 | 3/1983 | Willenbacher | 112/130 X |
| 4,491,079 | 1/1985 | Gustavsson | 112/130 X |
| 4,682,556 | 7/1987 | Block | 112/113 X |
| 4,708,072 | 11/1987 | Frye | 112/152 X |

*Primary Examiner*—Peter Nerbun

*Attorney, Agent, or Firm*—Donald P. Gillette

[57] ABSTRACT

An apparatus and method for feeding lengths of tape to a sewing location to be sewn onto other material is disclosed. In particular, it relates to apparatus that may be set to accept and feed tape that has any width within a predetermined range. The feeding operation includes holding the tape and cutting off an end portion of selectable length from the forward end of the tape being fed toward the sewing location and then feeding the cut-off portions, which may be patches, farther forward toward the sewing location.

6 Claims, 4 Drawing Sheets

FIG. 3
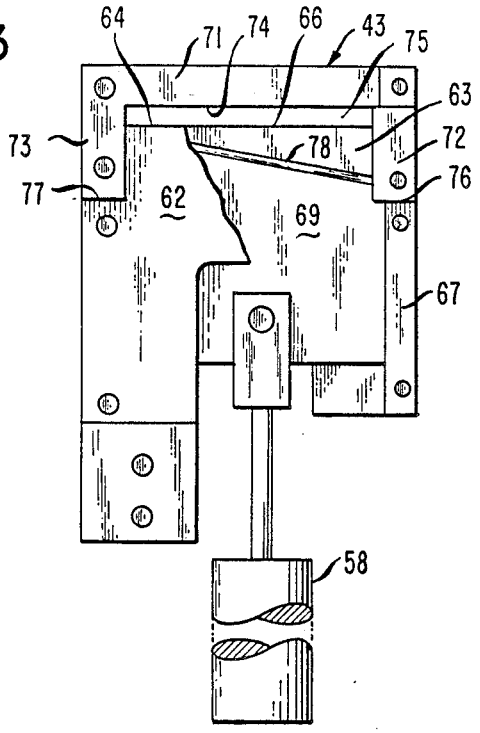
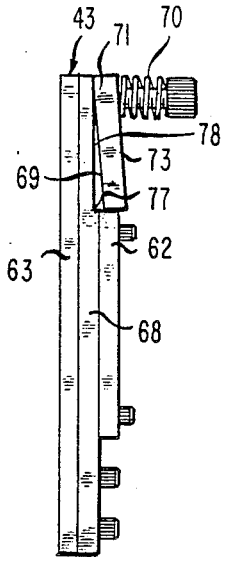
FIG. 4
FIG. 2
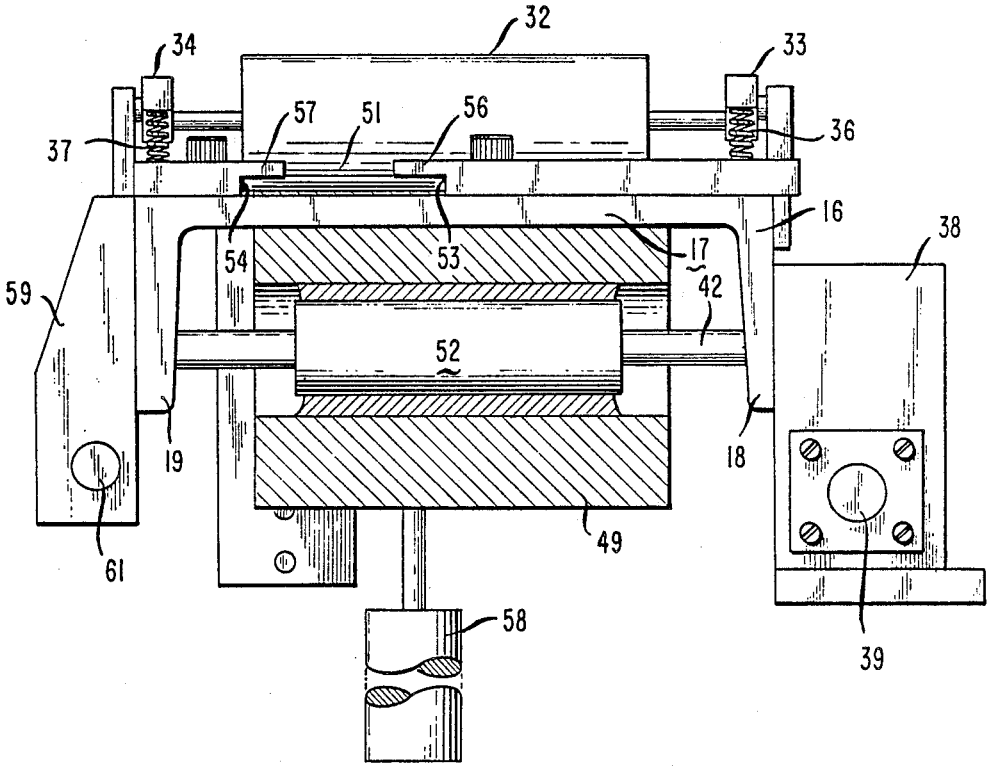

TAPE FEEDING METHOD AND APPARATUS

BACKGROUND OF THE INVENTION

There is a type of hook and loop tape known as Velcro ® that serves as a convenient means for joining two pieces of material together temporarily, but sufficiently well so that they will remain joined in spite of considerable force tending to slide them apart. However, they can relatively easily be separated by peeling one piece from the other. Velcro ® consists of base tape material to which small, resilient, plastic hooks are firmly joined so as to extend outwardly from one surface of the base material. The hooks are arranged in rows perpendicular to the length of the base material and are small enough and close enough together in both the length and width directions of the tape so that there are lots of hooks, even in a small patch of Velcro ® tape. When these hooks are pressed against the surface of a piece of cloth, they hook onto the threads or fibers of that material and hold on so firmly that the cloth cannot be slide relative to the tape without the use of a very high force. A patch of such tape sewn on the surface of one edge of a jacket, for example, will engage the juxtaposed surface of the other edge of the jacket and will hold those two edges together as well as if one had a button and the other a buttonhole. Yet the two edges can be separated with only moderate force if one of them is peeled away from the other.

In such tape, the hooks are normally restricted to the central part of the base material, leaving narrow regions free of hooks along the edges of the base material. The base material usually has a width in the range of about 12.5 mm. to about 50 mm., although the material can be narrower or wider than that typical range. The patches of tape to be sewn onto the surface of a first piece of material typically have a length of about 12.5 mm. to about 100 mm., although, as in the case of the width, the length can be outside of this typical range. Thus, when such tape is cut into small lengths, or patches, their rectangular dimensions are typically between about $12.5 \times 12.5$ mm. and about $50 \times 100$ mm.

One convention that will be followed in referred to these patches in the following description is that the dimension referred to as the width of the patch is the width dimension of the tape from which that patch is cut. The length of the patch is perpendicular to the width and is thus measured along the longitudinal direction of the tape. As a result, a patch may have a length smaller than its width, which is not the way one customarily refers to the dimensions of rectangles.

In the sewing industry it has been common to cut patches of the tape to the proper dimensions and to furnish the sewing machine operator with a box of such pre-cut patches. The operator separates one patch at a time from the others in the box, places the separated patch, together with the material onto which it is to be sewn, in the sewing location of a suitable sewing machine, and attaches the patch to the other material by forming a suitable pattern of stitches. In the case of a small patch, that pattern may simply be a row of stitches or a bar tack, and, whatever the pattern, there are many makes of sewing machines that will automatically form the desired pattern.

Although a single pattern of such tape can be extracted from a box of such patches more easily than that same patch could be peeled away from the surface of a piece of soft material, the separation of one patch from the others and the placement of the patch in the proper orientation in the sewing location and with the correct surface facing upward requires considerable dexterity and attention to the work, as well as a measurable amount of time. As a result, businesses that do that work would very much like to have some automatic means for feeding one of the patches at a time into the sewing location and with the proper surface of the patch facing up.

OBJECTS AND SUMMARY OF THE INVENTION

It is a principal object of this invention to provide automatic feeding apparatus to perform the functions desired, as just stated.

Another object is to cut one of the patches at a time from the end of a long piece of the tape shortly before that patch is automatically fed into the sewing location of a sewing machine.

Another object is to provide means to accommodate different widths of such tape by merely making simple adjustments in the feeding apparatus.

Still another object is to provide means for moving the patches, one at a time, from the cutting location to the sewing location.

A further object is to propel the end of the tape forward into means to sever a patch from the rest of it, and to control the propulsion quite accurately so that the increment of forward movement of the tape will be equal to the desired length of the patch.

A still further object is to provide propulsion means that grip the tape so that it can move only in one direction, whereby the patches will all have the desired length corresponding to the movement imparted by the propulsion means.

Yet another object is to provide feeding apparatus that can be used with a wide variety of sewing machines made by different sewing machine manufacturers.

Still further objects will be apparent from the following specification together with the drawings.

In accordance with this invention, the feeding apparatus includes rigid, elongated supporting means that has guiding means on it to guide tape of the type described. The tape is drawn onto the supporting means from a tape supply, such as a reel, by a one-way device that controls the movement of the tape so that it can either move forward toward the sewing location or can be stopped but is not free to move backward. The propulsion means may be a rotary actuator connected by a one-way clutch to a drum that has a roughened surface against which the tape is pressed for nonslipping engagement.

A device to sever a patch from the end portion of the tape is located between the propulsion means and the forward end of the supporting means. The tape-engaging portion of a device to hold each patch while it is being severed and to move it forward to the sewing location is located between the severing means and the sewing location, and, at that location, there is an adjustable cloth plate that forms a shallow nest closed on three sides to fit three edges of the patch and open on the fourth side through which each patch enters the nest.

Further in accordance with the invention, the guiding means includes two parallel walls, at least one of which can be moved toward and away from the other and then clamped to hold the proper spacing between the walls to accommodate the width of the tape being fed along the path defined by the guiding means. The propulsion means and the severing means extend across the path at their respective locations, requiring one or both walls to be formed in several pieces. In addition, the frame and other components of the sewing machine at the sewing location may be of different size from one make of machine to another, and that may require forming the forward portion of the guiding means so that that portion can be separately removed to allow the supporting means to be properly positioned with respect to each of the differemt machines.

BRIEF DESCRIPTION OF THE DRAWINGS

FIG. 2 is an end view of the feeding apparatus of FIG. 1.

FIGS. 3 and 4 show details of the severing means in FIG. 1.

DETAILED DESCRIPTION OF A PREFERRED EMBODIMENT

Figure 1:
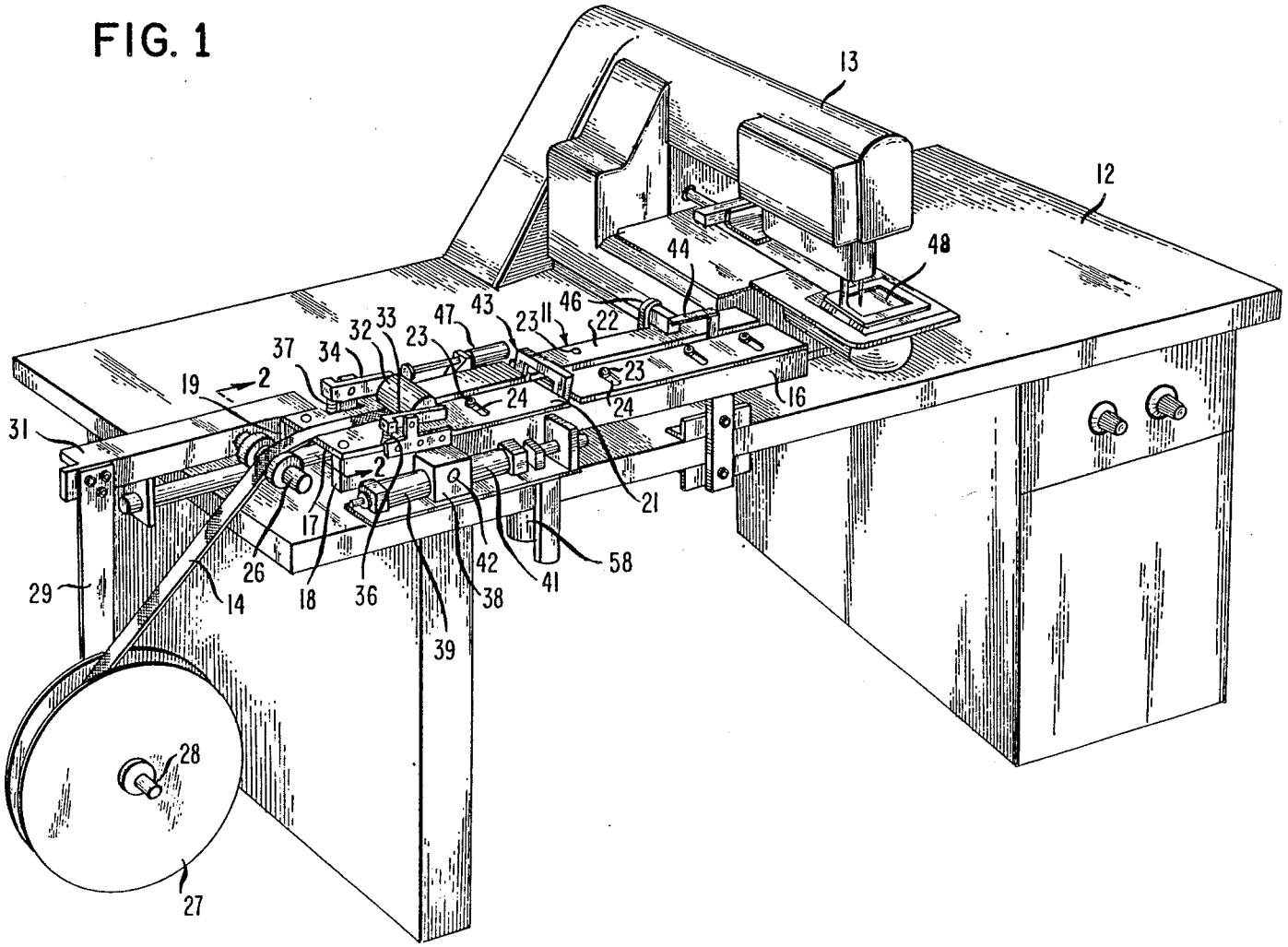
FIG. 1 is a perspective view of a sewing machine and the feeding apparatus of this invention.

FIG. 1 shows a feeding apparatus 11 mounted on the table 12 of a sewing machine 13. In this embodiment of the feeding apparatus, the main supporting means for both the Velcro® tape 14 and most of the feeding apparatus components is a member 16 that has a U-shaped cross-section with a flat top plate 17 and depending side flanges 18 and 19. The tape 14 slides along on the surface of the top plate and is guided in a straight line by guide means 21 and 22, which are plates attached to the main supporting means 16 by a plurality of screws 23. It will be noted that the screws that hold the guide means 21 rigidly in place on the top plate 17 pass through slots 24 that allow the guide means 21 to be moved toward and away from the guide means 22 while being kept parallel to the latter.

In order to reach the supporting means 16, the tape passes across a cylindrical guide 26 somewhat above and to the right of a reel 27 that constitutes a source of supply of the tape. The reel is mounted on an axle 28 supported at the lower end of a bar 29. In order to keep all of the components properly positioned with respect to each other, the bar 29 is bolted to a bracket 31 that is rigidly attached to the supporting means 16.

The tape is pulled from the reel by a roller that is not visible in FIG. 1 but is directly below and parallel to another roller 32. The latter is supported on two pivotally mounted arms 33 and 34, which are biased by springs 36 and 37, respectively, to force the roller down against the upwardly facing surface of the tape 14, thereby pressing the lower surface of the tape firmly against the roller below the roller 32. The lower roller is driven by a rotary actuator 38. The latter comprises cylinders 39 and 41 that control the linear position of piston means connected to a round gear, for example, by means of a rack. The round gear, in turn, is connected to the lower roller, and, when the cylinders 39 and 41 move the rack in one direction, the round gear rotates a shaft 42 attached to the shaft of the lower roller to rotate the latter in the proper direction (clockwise, in this instance) to force the tape 14 to move forward toward the sewing machine 13. The connection between the rotary actuator 38 and the lower roller is such that, when the fluid, which is usually air, that operates the cylinders 39 and 41 forces the piston means in the opposite direction, the lower roller free-wheels and does not apply any force to pull the tape 14 to the left, i.e., back toward the reel 27.

Located between the roller 32 and the sewing machine 13 is a cutting mechanism 43 that severs the end portion from the tape 14 in order to separate a patch from the main part of the tape. The severing operation cannot be carried out while the tape is being moved forward and thus has to be done while it is stationary. In order to hold the tape 14 stationary while it is being severed a pivotally mounted arm 44 is pressed firmly against the tape to force the tape firmly and immovably against the surface of the top plate 17. In FIG. 1 the arm 44 is shown some distance from the severing means 43, but the arm would normally be positioned much closer to the severing means during the severing operation. The arm 44 is pivotally mounted on a support 46 that, in turn, is mounted on slides that will be discussed in connection with another figure. It is sufficient at this time to say that the position farthest from the sewing machine 13 that the support, or carriage, 46 can move is limited by a stop 47. A fluid-operated cylinder 58 below the supporting means 16 actuates a movable knife blade (not shown in this figure) to sever the tape 14. The farthest the arm 44 can move in the forward direction, i.e., toward the sewing machine 13 is to a postion that brings the free end of the arm 44 into the sewing location 48 of the sewing machine 13.

The driving means to move the tape along the elongated support means 16 are shown better in FIG. 2, where it may be seen that the surface of the lower roller 49 is roughened, for example by being knurled, to provide a non-slipping surface to insure that the tape 14 cannot slide with respect to the roller, or drum, 49. The top plate 17 has a transverse slot through which the uppermost part of the roller 49 can extend to intersect with the channel 51 within which the tape 14 moves. The roller 49 is connected to the shaft 42 by a one-way clutch 52 that transfers rotary motion from the shaft 42 to the roller 49 as soon as there is the slightest rotation of the shaft 42 in the driving direction but entirely disconnects the shaft 42 from the roller 49 when the shaft 42 rotates in the opposite direction.

FIG. 2 also shows that the channel 51 is defined in part by vertical walls 53 and 54 of the guide means 21 and 22, respectively, and in part by overhanging roof portions 56 and 57 extending from the upper parts of the walls 53 and 54, respectively, and in the direction toward the opposite wall. The purpose of the overhanging roof portions is to constrain the tape 14 and prevent it from buckling as it is being pushed through the portion of the channel 51 between the roller 49 and the severing means 43.

FIG. 2 shows only a small, depending part of the severing means 43 and part of the fluid-operated cylinder 58 that actuates a movable blade (not shown in this figure) in the severing means. Also shown is a bracket 59 mounted rigidly on the supporting means 16 to hold one end of a fluid-operated cylinder 61. The purpose of this cylinder will be described in connection with another figure.

FIGS. 3 and 4 show the severing means 43 in more detail, The structure includes two plates 62 and 63 that have upper edges 64 and 66. The severing means is mounted in a slot in the supporting means 16 (FIG. 1) so that these edges are level with the upper surface of the top plate 17 to support the tape 14 as close as possible to the location at which it is being severed. Two side guides 67 and 68 are attached along opposite side edges of the plates 62 and 63 to space these plates just slightly farther apart than the thickness of a movable, guillotine blade 69. The upper edge of that blade slants to provide better cutting action, and it is beveled on the surface facing the plate 63. Another blade 71 has depending legs 72 and 73 attached to the guides 67 and 68 and to the plate 63 to support the blade 71 above the top surface of the tape 14. The cutting edge 74 of the blade 71 and the upper edges 64 and 66 of the plates 62 and 63 define a slot 75 wide enough to permit the widest tape for which the feeding apparatus is intended to be used to pass through. It will be noted that there is a shallow step 76 at the upper part of the guide 67 and a similar step 77 at the upper part of the guide 68. These steps are just below the lower ends of the legs 72 and 73. Furthermore, the legs are slightly wider than the guides 67 and 68, as shown in FIG. 3, so that the upper, unbeveled surface of the edge 78 of the movable blade 69 is always behind the legs 72 and 73. The upper part of the blade 71 is urged against the uppermost part of the guides 67 and 68 by springs 70, and, as a result, the blade 71 tilts slightly, as shown in FIG. 4. This tilt creates a scissoring action between the blades 69 and 71 when the blade 69 is forced up by the cylinder 58.

Figure 5:
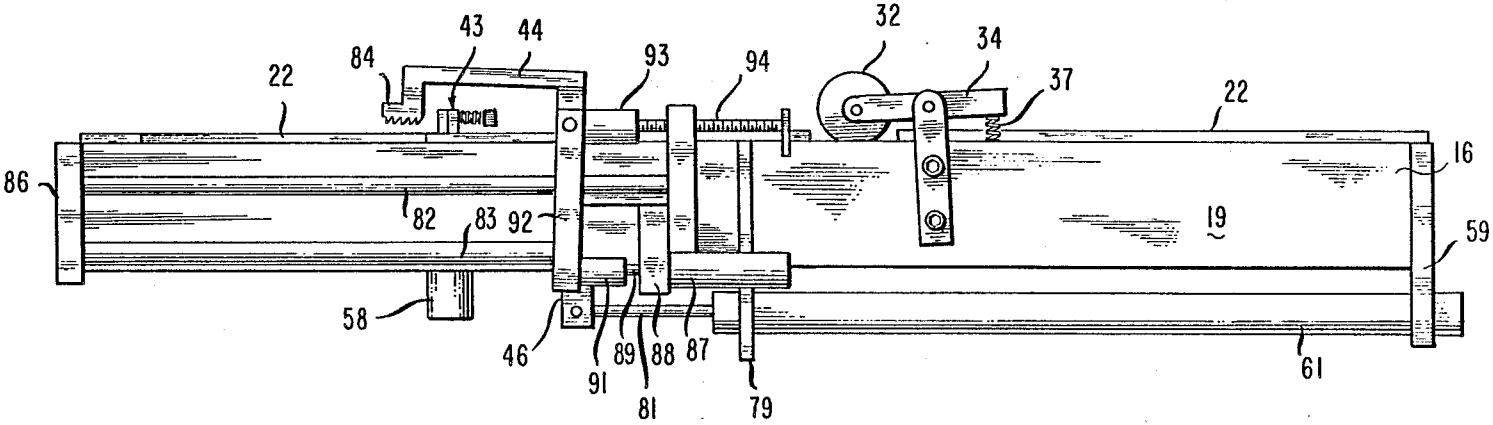
FIG. 5 shows the opposite side of the feeding apparatus in FIG. 1.

FIG. 5 shows the back side of the feeding apparatus 11. In addition to the bracket 59 for the cylinder 61, there is another bracket 79 in the central part of the flange 19 to hold the forward end of the cylinder 61. The piston rod 81 of this cylinder is connected to a carriage 46 on which the arm 44 is pivotally mounted, and this carriage is slidably supported on two rods 82 and 83 to move smoothly in response to actuation of the cylinder 61. The forward end 84 of the arm 44 is shown in FIG. 5 as being just forward of the severing means 43, which is as far to the rear of the feeding apparatus 11 as the arm 44 can go. The end 84 has a serrated surface to engage the upper surface of the end portion of the tape 44 when the arm is pivoted counterclockwise (in FIG. 5) to hold the end portion before the severing operation takes place. Thereafter, the arm continues to press down upon the severed end portion, now referred to as a patch, and the cylinder 61 is actuated to move the carriage 46, and the arm 44 and the patch along with the arm, forward toward the end 86 of the feeding apparatus 11. Although not shown in FIG. 5, this is the end that abuts the sewing machine 13 when the feeding apparatus is in use.

The arm 44 is pivoted on the carriage 46 by means of a fluid-operated cylinder 87 mounted on a part 88 of the carriage 46. The piston rod 89 of the cylinder 87 has a presser member 91 to engage an arm 92 rigidly attached to the arm 44 in the manner of a bell-crank lever. A stop 93 mounted on the end of a threaded rod 94 sets the rearwardmost position that can be reached by the arm 44, and, which the position shown in FIG. 5 is the extreme position, and is the position that would be used for having the end 84 engage small patches, the stop 93 can be moved forward if large patches are to be fed to the sewing machine 13.

Figure 6:
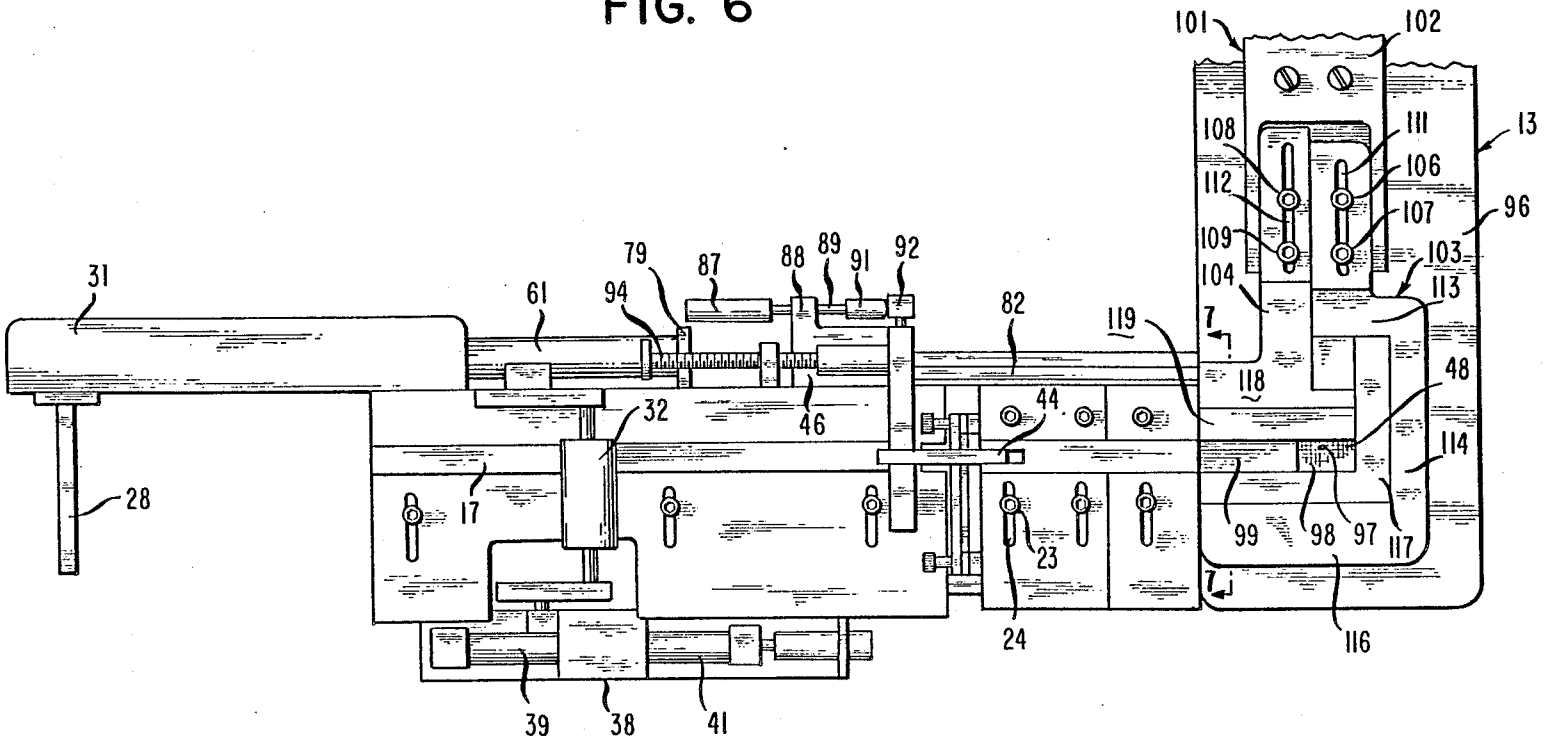
FIG. 6 is a top view of the feeding apparatus in FIG. 1.

FIG. 6 is a top view of the feeding apparatus 11 and the part of the sewing machine 13 that includes the sewing location 49. That location is on the bed or needle plate 96 and is the region adjacent the needle 97. It is to be understood that the machine is one of those that forms a pattern of stitches by moving the material and keeping the needle in a fixed location. FIG. 6 shows a patch 98 in the sewing location, which is at the end of a short channel 99 in an adjustable cloth plate 101. It is not necessary that the cloth plate be adjustable if only one width of tape is to be used, but if different widths are to be used, adjustability is desirable.

Figure 7:
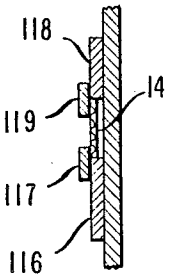
FIG. 7 is a cross-sectional view of a fragment of the apparatus in FIG. 6.

The adjustable cloth plate comprises a holder 102 to be attached to the movable carriage of the sewing machine 13, which is the part of the machine that moves the material in a programmed path to cause the desired pattern of stitches to be formed. The adjustable members of the cloth plate are identified by reference numbers 103 and 104, and they are affixed to the holder by screws 106–109 that pass through slots 111 and 112. The member 103 has a portion 113 that extends to one side and joins a portion 114 that extends perpendicular to the portion 113 and defines the righthand end of the channel 99. Extending perpendicularly from the portion 114 is a portion 116 that forms one side of the channel 99. The portions 113, 114, and 116 are made of sheet metal and an L-shaped piece of sheet metal 117 is welded thereto, partly to reinforce the portions 114 and 116 and partly to form a deeper nest at the end of the channel 99 to receive the patch 98. In addition, the edge of the sheet metal overhangs at least the edge of the portion 116 to help hold the patch in place, as shown in FIG. 7. The member 104 has a cross-member 118 at its end to define the opposite side of the channel 99 from the portion 116. Like the member 103, the member 104 is made of sheet metal and it has another piece of sheet metal 119 welded to it as a reinforcement and to provide an overhang, as shown in FIG. 7. The members 103 and 104 are set so that the channel 99 is directly in line with the channel defined by the guide means 21 and 22.

It will be noted that the guide means 21 and 22 are divided into short sections. Partly this is due to the fact that the roller 32 and the severing means 43 intersect the guide means, but the end sections 21*a* and 22*a* are separatey formed because some sewing machines with which the feeding apparatus is to be used have larger beds that the be 96 in FIG. 6.

What is claimed is:

1. The method of forming patches of tape from successive end portions of a tape supply and feeding the patches forward along a predetermined path toward a sewing location, said method comprising the steps of:

(a) propelling the current end portion of the tape supply a selected distance forward along the path, the selected distance being equal to the length of one of the patches;

(b) holding the current end portion to prevent unwanted movement thereof;

(c) severing the current end portion from the remainder of the tape supply to form one of the patches while continuing to hold that end portion; and (d) subsequently moving the just-cut patch farther along the path.

2. The method of claim 1 comprising the step of halting forward motion of the current end portion as soon as the current end portion has moved forward by the selected distance, and the step of holding the current end portion comprises holding it stationary during the severing, step.

3. The method of claim 1 in which the step of moving the just-cut patch comprises moving it in a straight line without rotation of the just-cut patch.

4. The method of forming one patch of tape at a time from successive end portions of an elongated piece of tape and feeding the patches forward, one at a time, to a sewing location to have stitches formed therein, said method comprising the steps of:

(a) moving the forward portion of the tape forward by a distance equal to one dimension of a patch;

(b) engaging an end portion of the tape corresponding to one of the patches;

(c) holding that end portion stationary to be severed;

(d) severing said end portion as a patch from the remainder of the tape while continuing to hold said end portion to prevent undesired movement thereof; and (e) feeding the just-severed patch forward to the sewing location while continuing to hold the same against undesired movement.

5. The method of forming patches of tape from successive end portions of a tape supply and feeding the patches toward a sewing location, said method comprising the steps of:

(a) propelling the current end portion of the tape a selected distance forward along a path toward the sewing location, said distance being equal to the length of one of the patches;

(b) holding the current end portion stationary prior to severing it from the remainder of the tape supply;

(c) severing the current end portion from the remainder of the tape supply while continuing to hold said end portion, whereby the severed end portion constitutes a just-cut one of the patches; and (d) moving the just-cut patch farther along a continuation of the path toward the sewing location while continuing to hold said patch to prevent undesired movement thereof.

6. The method of claim 5 in which the step of moving the just-cut patch is limited to movement in a straight line.

* * * * *